United States Patent [19]

Hirsbrunner et al.

[11] 4,138,251

[45] Feb. 6, 1979

[54] ELECTRICAL CONTACT MATERIAL

[75] Inventors: Hans G. Hirsbrunner, Attleboro, Mass.; Stephen B. Goldman, Dallas, Tex.

[73] Assignee: Texas Instruments Incorporated, Dallas, Tex.

[21] Appl. No.: 801,503

[22] Filed: May 31, 1977

[51] Int. Cl.[2] ..... B22F 3/00

[52] U.S. Cl. ..... 75/234; 75/235; 200/260; 200/265

[58] Field of Search ..... 75/234, 235; 200/265, 200/260

[56] References Cited

U.S. PATENT DOCUMENTS

| | | | |
|---|---|---|---|
| 2,861,155 | 11/1958 | Farnham et al. | 200/266 |
| 2,890,315 | 6/1959 | Graves, Jr. | 200/266 |
| 3,489,531 | 1/1970 | Schreiner et al. | 75/235 |

FOREIGN PATENT DOCUMENTS

| | | | |
|---|---|---|---|
| 2102996 | 8/1972 | Fed. Rep. of Germany | 75/235 |

*Primary Examiner*—Brooks H. Hunt
*Attorney, Agent, or Firm*—John A. Haug; James P. McAndrews

[57] ABSTRACT

An electrical contact material comprising a homogeneous, pressed and sintered mixture of from 85 to 90 percent silver metal powder, from 7.5 to 14.3 percent cadmium oxide powder, and from 0.50 to 3.0 percent zinc oxide powder, by weight, and having a weight ratio of zinc oxide to cadmium oxide content in the range from 0.05 to 0.25, is shown to display remarkably improved arc erosion and welding properties.

4 Claims, 4 Drawing Figures

ELECTRICAL CONTACT MATERIAL

Figure 1:
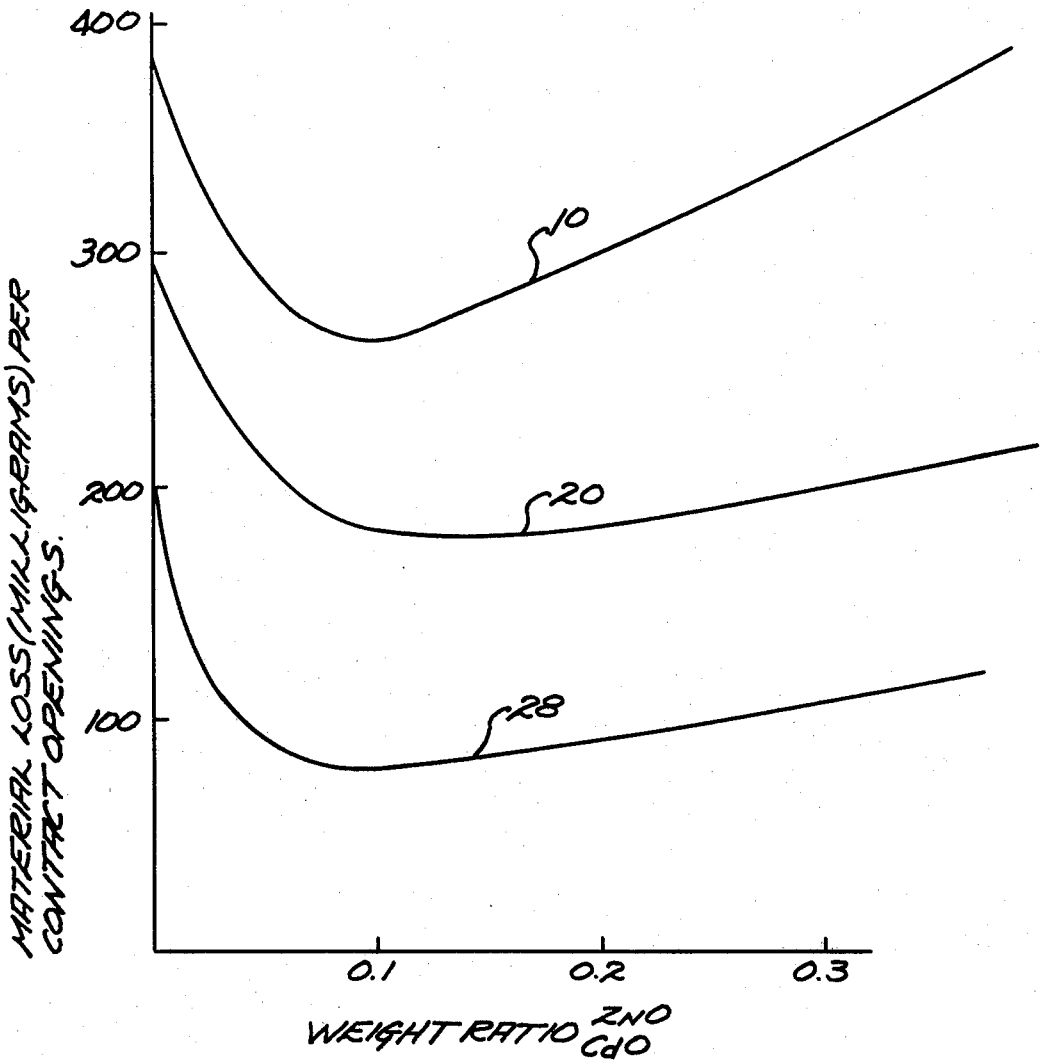

When electrical circuits carrying substantial loads are opened and closed by engagement and disengagement of electrical contacts, high temperatures and substantial electrical arcing occurs between the contacts. This tends to result in splattering of molten metal from the contact surfaces and to cause erosion or wearing away of the contact surfaces. On reengagement of the contacts with corresponding arcing, there is also a tendency for the surfaces of the mating contacts to weld together so that substantial force may be required in reopening the contacts. When substantial arc erosion loss has occurred, the contacts have to be replaced or, with substantial welding, catastrophic failure can occur. For these reasons, where heavy duty or high reliability contacts have been required, it has been the practice for many years to use contacts having a metal oxide particulate dispersed in a metal matrix. Typically such contact have incorporated cadmium oxide particles in a silver matrix although other metal oxides and matrix metals have also been used. In such contacts, the matrix metal has provided high electrical conductivity and low contact resistance while the presence of the metal oxide constituent has significantly improved the arc erosion and reduced the welding tendencies of the contacts. Such contacts have commonly been formed with conventional powder metallurgy techniques by pressing and sintering silver metal powder together with a cadmium oxide powder, for example. Similar contacts have also been formed by internally oxidizing the cadmium content of a silver cadmium alloy in situ, with or without the use of a grain refining agent in the alloy, to assure that a dispersion of very fine cadmium oxide particles is formed in the silver matrix. However, particularly because of the high cost due to the silver content of such contacts, it would be desirable if even further improvement of the arc erosion and welding resistance properties of such contacts could be effected.

It is an object of this invention to provide novel and improved electrical contact materials; to provide such materials which display high electrical conductivity, which display improved resistance to erosion during arcing, which display improved resistance to welding after such arcing, and which display remarkably increased service life.

Briefly described, the novel and improved electrical contact materials of this invention are made by known powder metallurgy techniques and incorporate a homogeneous mixture of silver metal powder, cadmium oxide powder, and zinc oxide powder where the weight ratio of zinc oxide to the cadmium oxide content of the materials is maintained within a narrow range. Where the contact materials are formed by known powder metallurgy techniques with the constituents kept within the ranges as specified hereinafter, the contact materials are found to display remarkably reduced surface erosion during the electrical arcing which occurs during their use. Contacts formed of the material also display a reduced tendency to weld together during such arcing with the result that the contacts display remarkably improved service life even when used under heavy load conditions.

Figure 2:
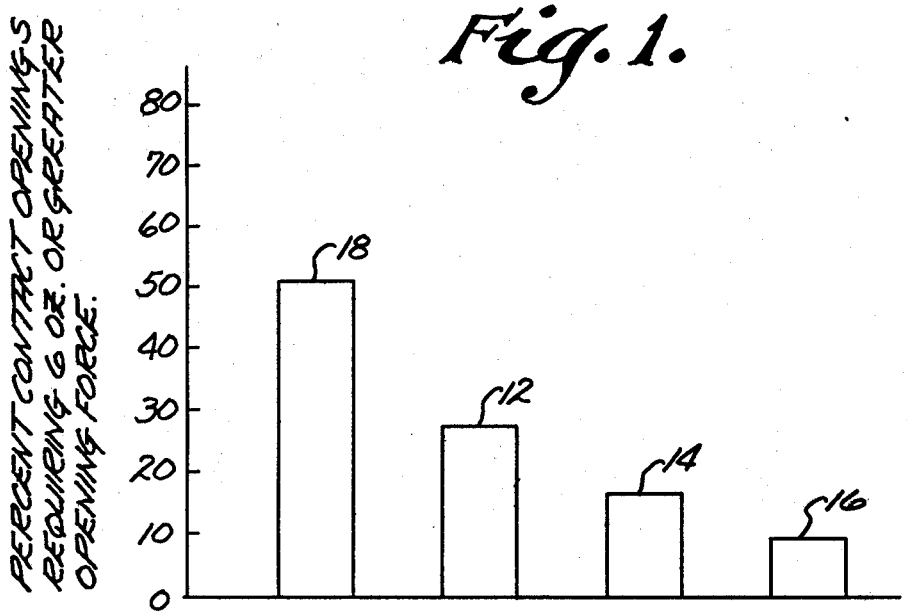
Figure 3:
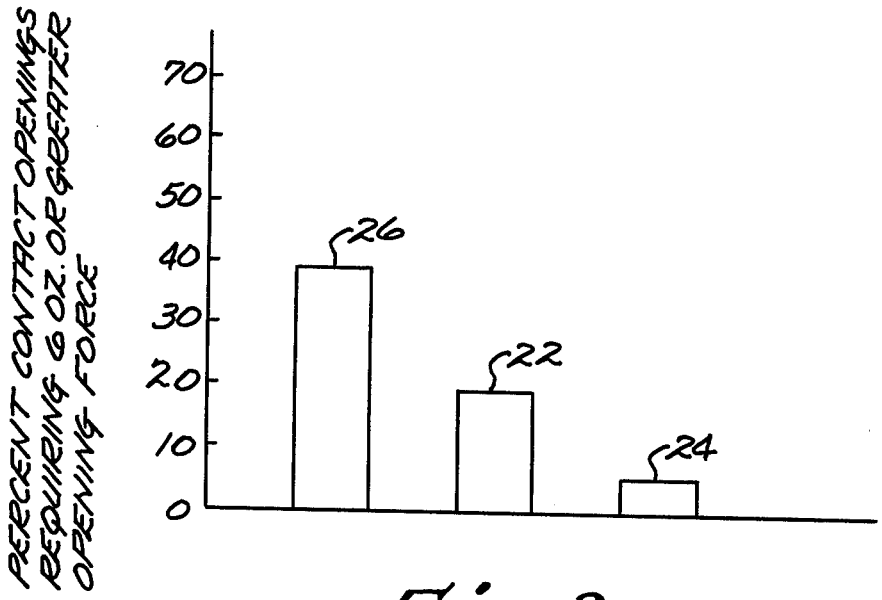
Figure 4:
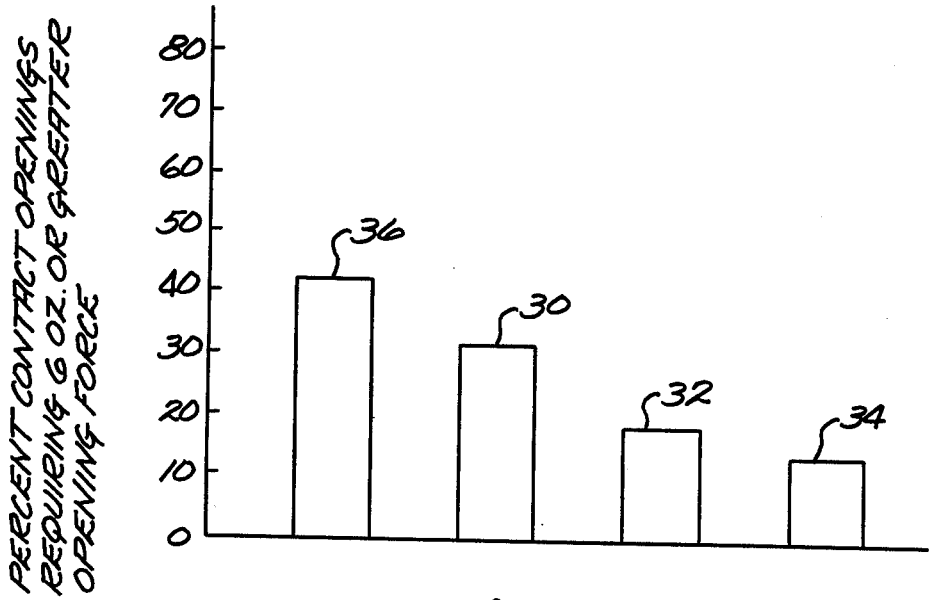

Other objects, advantages, and details of the novel and improved electrical contact materials of this invention appear in the following detailed description of preferred embodiments of the invention, the detailed description referring to the drawings in which:

FIG. 1 is a graph illustrating the arc erosion properties of the contact materials provided by this invention; and FIGS. 2–4 are bar graphs illustrating the welding resistance properties of the contact materials of the invention.

In accordance with this invention, the novel and improved electrical contact materials of this invention incorporate from about 85 to 90 percent by weight silver metal powder with the silver content being varied as required to achieve desired contact surface resistance, resistivity, and malleability at a desired cost. This silver metal powder is thoroughly mixed with cadmium oxide powder and zinc oxide powder. The cadmium oxide content of the mixture is regulated so that it constitutes from about 7.5 to 14.3 percent by weight of the mixture while the zinc oxide content of the mixture is regulated to constitute from about 0.50 to 3.0 percent by weight of the mixture. The cadmium oxide and zinc oxide contents of the mixture are also regulated so that the weight ratio of the zinc oxide to the cadmium oxide content is kept within the range from about 0.05 to 0.25. The mixture is then pressed and sintered in accordance with conventional powder metallurgy techniques to provide electrical contacts, or strips or material from which electrical contacts can be cut in any conventional manner, as may be desired. For the surface resistance, resistivity, malleability and cost levels achieved, these electrical contacts are found to display very low arc erosion and remarkably reduced tendency to weld during use.

In a preferred embodiment of this invention, for example, silver metal powder, cadmium oxide powder, and zinc oxide powder are combined with the silver metal comprising 90 weight percent, the cadmium oxide comprising 9.25 weight percent, and the zinc oxide comprising 0.75 weight percent of the resulting mixture. In this composition, the weight ratio of zinc oxide to cadmium oxide is 0.080. The powder mixture is preferably prepared by known coprecipitation processes to provide a homogeneous mixture and is then pressed and sintered in air at 800° to 850° C. for about 1 to 4 hours in accordance with conventional powder metallurgy techniques and is coined to form individual electrical contacts, the powder materials being selected so that the majority of the oxide particles in the resulting contact materials are preferably in the range from 0.25 to 0.65 microns. Preferably the contacts are formed with a diameter of 0.437 inches and a thickness of 0.55 inches and with a crown of about 1.25 inches radius on one surface. With this silver content the contact material displays a desired resistivity and malleability.

After weighing, the contacts were mounted in mating pairs in an electrical circuit having half-wave applied voltage of about 10 volts a.c. at 5,000 amperes and the circuit was repeatedly opened by disengaging the contacts to test the arc erosion properties of the contact materials with only a single polarity relationship between the contacts. Substantial arcing occurred during contact disengagement and, after opening, the circuit was interrupted by other means while the contacts were reengaged. The contacts were opened at a speed of about 100 centimeters per second with a force of 1 kilogram. The contacts were reengaged with a force of 2 kilograms. The contacts were reweighed after each 100 openings as described and the weight loss of the contacts was determined. As shown in curve 10 in FIG. 1, the weight loss of these high silver content contacts was only about 265 milligrams for each 100 openings of the noted circuit.

Other contacts produced in the manner described above were then mounted in mating pairs in an electrical circuit having an open circuit voltage of 108 volts d.c. and at 240 amperes to test the weld resistance properties of the contact materials. The contacts were briefly opened to a spacing of 0.0125 inches and were then reclosed so that arcing occurred between the contacts for 6 milliseconds. The contacts were closed with a contact engagement force of 32 ounces. After closing, the contacts were separated while the force required for separation was measured. As indicated by bar 12 in FIG. 2 only about 28 of each 100 contact openings required a contact separating force of 6 ounces or more.

In another preferred embodiment of the invention, contacts were prepared and tested in a similar manner, the contact material comprising 90 weight percent silver metal, 8.50 weight percent cadmium oxide, and 1.50 weight percent zinc oxide so that the weight ratio of zinc oxide to cadmium oxide content was 0.176. As shown in curve 10 in FIG. 1, the contact material showed an arc erosion weight loss of only 295 milligrams per 100 contact openings and during the test for welding properties only 18 of the contact openings required a contact separation force in excess of 6 ounces as shown by bar 14 in FIG. 2.

In another preferred embodiment of the invention, contacts were prepared and tested in a similar manner, the contact material comprising 90 weight percent silver metal, 8.00 weight percent cadmium oxide, and 2.00 weight percent zinc oxide so that the weight ratio of zinc oxide to cadmium oxide content was 0.250. As shown in curve 10 in FIG. 1, the contact material showed an arc erosion weight loss of only 327 milligrams per 100 contact openings and during the test for welding properties only 9 of the contact openings required a contact separation force of 6 ounces or more as shown by bar 16 in FIG. 2.

For comparison purposes, contacts were also prepared and tested in a similar manner, the contact material comprising 90 weight percent silver metal, 7.00 weight percent cadmium oxide, and 3.00 weight percent zinc oxide so that the weight ratio of zinc oxide to cadmium oxide content was 0.428. As shown in curve 10 in FIG. 1 the contact material showed arc erosion weight loss increased to over 400 milligrams per 100 contact openings.

For comparison purposes, contacts were also prepared omitting the zinc oxide constituent and were tested in a similar manner, the contact material comprising 90 weight percent silver metal, and 10.0 weight percent cadmium oxide. As shown in curve 10 in FIG. 1, the contact material showed an arc erosion weight loss of about 380 milligrams per 100 contact openings and during the test for welding properties 53 of the contact openings required a contact separation force of 6 ounces or more as shown by bar 18 in FIG. 2.

In another preferred embodiment of the invention, contacts were prepared and tested in a similar manner, the contact material comprising 87.5 weight percent silver metal, 11.50 weight percent cadmium oxide, and 1.00 weight percent zinc oxide so that the weight ratio of zinc oxide to cadmium oxide content was 0.087. With this decreased silver content, the contacts displayed somewhat greater resistivity, but were manufacturable at relatively lower cost. As shown in curve 20 in FIG. 1, the contact material showed an arc erosion weight loss of only 192 milligrams per 100 contact openings and during the test for welding properties only 17 of the contact openings required a contact separation force of 6 ounces or more as shown by bar 22 in FIG. 3.

In another preferred embodiment of the invention, contacts were prepared and tested in a similar manner, the contact material comprising 87.5 weight percent silver metal, 10.50 weight percent cadmium oxide, and 2.00 weight percent zinc oxide so that the weight ratio of zinc oxide to cadmium oxide content was 0.190. As shown in curve 20 in FIG. 1, the contact material showed an arc erosion weight loss of only about 200 milligrams per 100 contact openings and during the test for welding properties only 7 of the contact openings required a contact separation force of 6 ounces or more as shown by bar 24 in FIG. 3.

For comparison purposes contacts were also prepared and tested in a similar manner, the contact material comprising 87.5 weight percent silver metal, 8.50 weight percent cadmium oxide, and 4.00 weight percent zinc oxide so that the weight ratio of zinc oxide to cadmium oxide content was 0.470. As shown in curve 20 in FIG. 1, the contact material showed arc erosion weight loss increased to 225 milligrams per 100 contact openings.

For comparison purposes contacts were also prepared omitting the zinc oxide constituent and were tested in a similar manner, the contact material comprising 87.5 weight percent silver metal, and 12.50 weight percent cadmium oxide. As shown in curve 20 in FIG. 1, the contact material showed an arc erosion weight loss increased to 290 milligrams per 100 contact openings and during the test for welding properties 39 of the contact openings required a contact separation force of 6 ounces or more as shown by bar 26 in FIG. 3.

In another preferred embodiment of the invention, contacts were prepared and tested in a similar manner, the contact material comprising 85 weight percent silver metal, 14.35 weight percent cadmium oxide, and 0.65 weight percent zinc oxide so that the weight ratio of zinc oxide to cadmium oxide content was 0.045. With this further decreased silver content, the materials displayed further increased resistivity but were manufacturable at further reduction in cost. As shown in curve 28 in FIG. 1, the contact material showed an arc erosion weight loss of only 90 milligrams per 100 contact openings and during the test for welding properties only 32 of the contact openings required a contact separation force of 6 ounces or more as shown by bar 30 in FIG. 4.

In another preferred embodiment of this invention, contacts were prepared and tested in a similar manner, the contact material comprising 85 weight percent silver metal, 13.00 weight percent cadmium oxide, and 2.00 weight percent zinc oxide so that the weight ratio of zinc oxide to cadmium oxide content was 0.154. As shown in curve 28 in FIG. 1, the contact' material showed an arc erosion weight loss of only 85 milligrams per 100 contact openings and during the test for welding properties only 18 of the contact openings required a contact separation force of 6 ounces or more as shown by bar 32 in FIG. 4.

In another preferred embodiment of the invention, contacts were prepared and tested in a similar manner, the contact material comprising 85 weight percent silver metal, 12.00 weight percent cadmium oxide, and 3.00 weight percent zinc oxide so that the weight ratio of zinc oxide to cadmium oxide content was 0.250. As shown in curve 28 in FIG. 1, the contact material showed an arc erosion weight loss of only 100 milligrams per 100 contact openings and during the test for welding properties only 14 of the contact openings required a contact separation force of 6 ounces or more as shown by bar 34 in FIG. 4.

For comparison purposes, contacts were also prepared and tested in a similar manner, the contact material comprising 85 weight percent silver metal, 10.00 weight percent cadmium oxide, and 5.00 weight percent zinc oxide so that the weight ratio of zinc oxide to cadmium oxide was 0.500. As shown in curve 28 in FIG. 1, the contact material showed arc erosion weight loss increased to over 135 milligrams per 100 contact openings.

For comparison purposes, contacts were also prepared omitting the zinc oxide constituent and tested in a similar manner, the contact material comprising 85 weight percent silver metal, and 15.00 weight percent cadmium oxide. As shown in curve 28 in FIG. 1, the contact material showed an arc erosion weight loss increased to almost 200 milligrams per 100 contact openings and during the test for welding properties 43 of the contact openings required a contact separation force of 6 ounces or more as shown by bar 36 in FIG. 4.

It can therefore be seen that for the electrical conductivity, malleability and manufacturing costs achieved, electrical contact materials as provided by this invention display remarkably improved arc erosion properties and resistance to contact welding.

It should be understood that although preferred embodiments of this invention are described by way of illustrating this invention, the invention includes all modifications and equivalents of the disclosed embodiments falling within the scope of the appended claims.

What is claimed:

1. An electrical contact material comprising a homogeneous, pressed and sintered mixture of from 85 to 90 percent silver metal powder, from 7.5 to 14.3 percent cadmium oxide powder, and from 0.50 to 3.0 percent zinc oxide powder, by weight, wherein the weight ratio of the zinc oxide to cadmium oxide content of the material is in the range from 0.05 to 0.25.

2. An electrical contact material as set forth in claim 1 comprising about 85 percent silver, from 12.00 to 14.35 percent cadmium oxide, and from 0.65 to 3.00 percent zinc oxide, by weight.

3. An electrical contact material as set forth in claim 1 comprising about 87.5 percent silver, from 10.50 to 11.50 percent cadmium oxide, and from 1.00 to 2.00 percent zinc oxide, by weight.

4. An electrical contact material as set forth in claim 1 comprising about 90 percent silver, from 8.00 to 9.25 percent cadmium oxide, and from 0.75 to 2.00 percent zinc oxide, by weight.

* * * * *